US009185782B2

(12) United States Patent
Hinrichs et al.

(10) Patent No.: US 9,185,782 B2
(45) Date of Patent: Nov. 10, 2015

(54) LIGHT CONTROLLER WITH LOCKED SPLIT HANDLE

(71) Applicant: Martin Professional A/S, Aarhus N (DK)

(72) Inventors: Matthias Hinrichs, Prior Lake, MN (US); Chris Foblets, Genk (BE)

(73) Assignee: Martin Professional A/S, Aarjus N. (DK)

( * ) Notice: Subject to any disclaimer, the term of this patent is extended or adjusted under 35 U.S.C. 154(b) by 0 days.

(21) Appl. No.: 14/173,608

(22) Filed: Feb. 5, 2014

(65) Prior Publication Data

US 2014/0203727 A1 Jul. 24, 2014

(51) Int. Cl.

| | |
|---|---|
| ***H05B 37/02*** | (2006.01) |
| ***G05G 1/02*** | (2006.01) |
| ***G05G 1/04*** | (2006.01) |
| ***G05G 5/08*** | (2006.01) |

(52) U.S. Cl.

CPC ..... *H05B 37/0245* (2013.01); *G05G 1/025* (2013.01); *G05G 1/04* (2013.01); *G05G 5/08* (2013.01); *H05B 37/0254* (2013.01)

(58) Field of Classification Search

CPC ..... G05G 1/025; G05G 1/04; G05G 5/08; H05B 37/02; H05B 37/029; H05B 37/0245; H05B 37/0254; G06F 3/0451

USPC ..... 315/292, 297, 312, 316, 361; 362/85, 362/233, 319, 655, 652; 700/17, 20; 250/205

See application file for complete search history.

(56) References Cited

U.S. PATENT DOCUMENTS

| | | | | |
|---|---|---|---|---|
| 3,181,388 | A | 5/1965 | Riddy | |
| 5,329,431 | A * | 7/1994 | Taylor et al. | 362/85 |
| 5,802,185 | A * | 9/1998 | Hansen | 381/98 |
| 6,606,081 | B1 * | 8/2003 | Jaeger et al. | 345/111 |
| 6,777,891 | B2 * | 8/2004 | Lys et al. | 315/291 |
| 7,829,831 | B2 * | 11/2010 | Klinghult | 250/205 |
| 8,536,792 | B1 * | 9/2013 | Roosli | 315/159 |
| 8,696,460 | B2 * | 4/2014 | Odinot et al. | 463/37 |

(Continued)

FOREIGN PATENT DOCUMENTS

GB 2291492 A 1/1996

OTHER PUBLICATIONS

Eurolite, "User Manual DMX Scene Setter 24-channel lighting controller", Apr. 8, 2013, 23 pages.

(Continued)

*Primary Examiner* — Haissa Philogene
(74) *Attorney, Agent, or Firm* — Brooks Kushman P.C.

(57) ABSTRACT

The present invention relates to a light controller for controlling a lightning system, where the lightning system comprises a number of light emitting devices such as controllable light fixtures, controllable light emitting visual devices and/or controllable display devices adapted to emit video content. The light controller comprises a first slide controller, a second slide controller, and a locking mechanism adapted to fix the first slide controller and the second slide controller in relation to each other, such that movement of at least one of the slide controllers forces the other slide controller to perform a corresponding movement.

18 Claims, 5 Drawing Sheets

(56) References Cited

U.S. PATENT DOCUMENTS

| | | | | |
|---|---|---|---|---|
| 2003/0057884 | A1* | 3/2003 | Dowling et al. | 315/291 |
| 2005/0275626 | A1* | 12/2005 | Mueller et al. | 345/156 |
| 2008/0136334 | A1* | 6/2008 | Robinson et al. | 315/151 |
| 2009/0312011 | A1* | 12/2009 | Huomo et al. | 455/426.1 |
| 2011/0156862 | A1* | 6/2011 | Langer | 340/4.37 |
| 2011/0166724 | A1 | 7/2011 | Hiramatsu | |
| 2011/0212780 | A1 | 9/2011 | Odinot et al. | |

OTHER PUBLICATIONS

European Search Report for corresponding Application No. 14151387.9, mailed Jun. 26, 2014, 8 pages.

Danish Search Report for corresponding Application No. PA 2013 70024, Aug. 8, 2013, 1 page.

Danish Office Action for corresponding Application No. PA 2013 70024, mailed Aug. 8, 2013, 3 pages.

* cited by examiner

LIGHT CONTROLLER WITH LOCKED SPLIT HANDLE

CROSS-REFERENCE TO RELATED APPLICATIONS

This application claims priority to Danish Application No. PA 2013 70024, filed Jan. 18 2013, the disclosure of which is incorporated in its entirety by reference herein.

TECHNICAL FIELD

The present invention relates to a light controller for controlling a lighting system, where the lighting system comprises a number of light emitting devices such as controllable light fixtures, controllable light emitting visual devices, and/or controllable display devices adapted to emit video content.

BACKGROUND

Light controllers adapted to control a number of light emitting devices in a lighting system are widely known in the field of dynamic light controlling typically used in connection with entertainment lighting systems.

The light controller acts as the primary controller adapted to send control commands to the light emitting devices in the light systems and can, as a consequence, be used to create very complex light shows. The light commands can be sent automatically to the light emitting devices but can also be executed manually using user input interfaces such as bottoms, slide controllers, rotary buttons/encoders, touch screens or other input devices. The lighting designers and programmers use the light controller to program and reprogram sequences of light effects which are executed during the light show. Further the light operator uses the light controller when executing the light show.

Many lighting systems comprise a plurality of different light emitting devices of different types and manufactures. Typically, the different light emitting devices have different functionality and require specific control commands in order to work properly, and as a consequence, it is very time consuming for the lighting designers and programmers to program the light show.

One of the challenges when executing light shows is to provide manual fading of different light effects. Often the fade of light effects must be performed manually for instance in order to follow the artist and/or stage play and this is challenging when two light effects need to be faded simultaneously as this needs to be performed using two independent slide controllers and/or rotary encoders and it can be difficult to perform such fading in proper sync. Further, there is a great risk that things may go wrong if something/somebody disturbs the light operator during the cross fading.

Another issue is the fact that graphical content is getting more and more integrated into light shows, and in some situations, live images are also integrated in the light shows for instance shown on large display walls and/or by projectors. In some situations, the graphical content need to be synchronized with several lighting effects in a smooth and very precise way however existing light controllers do not provide sufficient means for such action especially when such synchronization needs to be performed manually.

SUMMARY

The object of the present invention is to solve the above described limitations related to prior art. This is achieved by a light controller as defined in the independent claims. The dependent claims describe possible embodiments of the present invention. The advantages and benefits of the present invention are described in the detailed description of the invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
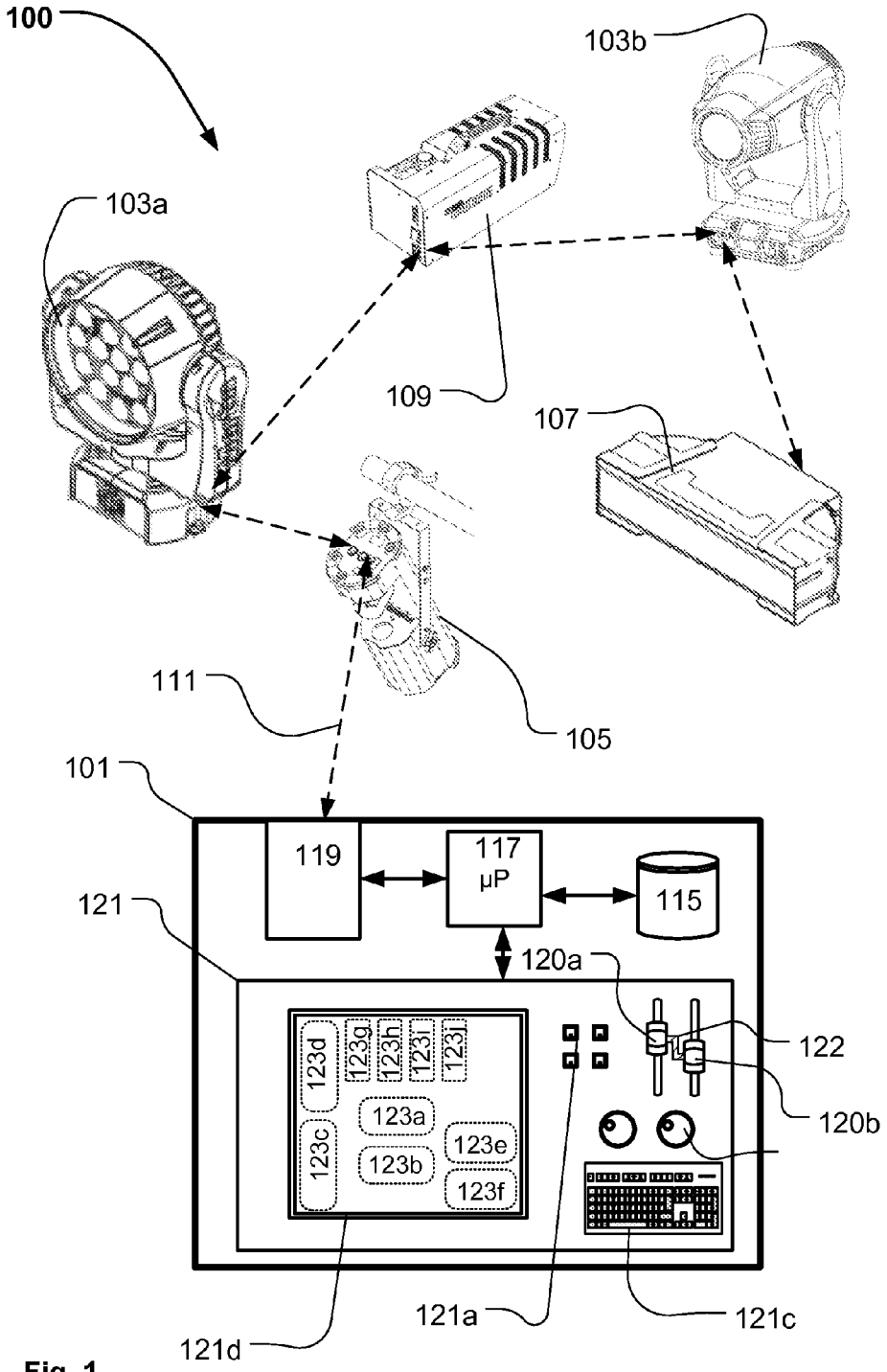
FIG. 1 illustrates a light system comprising a light controller according to the present invention.

FIG. 1 illustrates a lighting system 100 comprising a light controller 101 according to the present invention. The light controller 101 is connected to a number of entertainment devices, for instance, light effect devices such as moving heads 103*a* and 103*b*, scanners 105, LED light bars 107 or any other controllable light fixture, controllable light emitting visual device or controllable display device (adapted to emit video). Further, a number of smoke/fog/haze generators 109 and actuators for controlling stage parts (not shown) can also be a part of the lighting system. The light controller 101 controls the light effects apparatus and smoke generators using a light control signal 111 (illustrated in dashed lines) as known in the art of entertainment lighting systems. In the illustrated embodiment, the control signal is a DMX (Digital Multiplier) and/or RDM (Remote Device Management) signal and the light emitting devices of the lighting system 100 is daisy chained. However, it is to be understood that splitters as known in the art of entertainment lighting systems can be used to create different sub chains. Further, the light controller can control multiple number universes (different chains). The light control signal can, for instance, be based on any standard light control protocols such as DMX, ESTA (Entertainment Services and Technology Association), or ACN (Architecture for Control Networks—ANSI E1.17—2006). DMX refers to any of the standards known in the art, such as USITT (United States Institute for Theatre Technology) DMX 512, USITT DMX 512 1990, USITT DMX 512-A and DMX-512-A including RDM, as covered by ANSI (American National Standards Institute) E1.11 and ANSI E1.20 standards. The light control signal can also be based on other networks for data communication, for instance the light emitting devices can be controlled through the internet, LAN (Local Area Network) or WLAN (Wireless LAN), such as ArtNET or ArtNetII protocols from Artistic License. However, other communication protocols can also be used.

The light controller 101 is illustrated as a structural diagram and comprises a memory 115 wherein a number of control commands associated with at least one of the entertainment devices in the lighting system are stored. The control commands can be any control command known in the art of entertainment lighting and can for instance be commands used to control different parameters or the entertainment devices, such as pan and tilt movement of a moving head and/or scanning mirror, the color or intensity of the generated light, various light effects such as gobo, animation, iris, framing, prism effects, smoke type, smoke density activation of actuators etc. The control commands can also be macros or cues defining different lighting scenes and which can control a multiple number of the entertainment devices. A processor 117 is adapted to send light control commands to the entertainment devices based on the control commands stored in the memory 115 using communication interface 119. The communication interface 119 is adapted to send the light control commands to the entertainment devices through a standard lighting protocol 111, whereby the entertainment devices acts as instructed. Some lighting protocols such as RDM enables also the light emitting devices to return responses to the light controller 101 and the communication interface 119 is thus also capable of receiving such responses and send these to the processor 117 for evaluation.

The processer 117 can further be adapted to send the light control commands based on a predefined execution schema (cue list) also stored in the memory or based on user input received through user input interface 121. The processor 117 can also be adapted to control the light control commands based on other input signals such as music signals (MIDI) or other trigger signals (Time code signals). The user input interface 121 can comprise a number of user input interfaces such as slide controllers, buttons 121*a*, rotary buttons/encoders 121*b*, track balls (not shown), joysticks (not shown), motion sensors (not shown), keyboard 121*c* or other input devices.

The user input interface 121 can also comprise a touch sensitive display 121*d* adapted to display graphical elements 123*a-j*, where the graphical elements defines an area (illustrated as dotted boxes) of the touch sensitive display 121*e*. The graphical elements are associated with at least one of the control commands stored in the memory. As a consequence the user can activate the control commands by touching the graphical elements on the touch screen and hereby provide user inputs related to the control commands by touching the graphical elements 123*a-j* on the touch sensitive display 121*e*.

The input interface 121 of the light controller 101 according to the present invention comprises a lockable slide controller pair comprising a first slide controller 120*a* and a second slide controller 120*b*. Each of the slide controllers 120*a*, 120*b* are movable between a minimum position and a maximum position and can be positioned at a number of positions between the minimum position and the maximum position.

The input interface 121 further comprises a locking mechanism 122 adapted to fix the first slide controller 120*a* and said second slide controller 120*b* in relation to each other, such that movement of the first slide controller 120*a* forces the second slide controller 120*b* to perform a corresponding movement and/or such that movement of the second slide controller 120*b* forces the first slide controller 120*a* to perform a corresponding movement. The locking mechanism 122 can be embodied as any means capable of locking the first slide controller 120*a* and the second slide controller 120*b* in relation to each other. For instance, the locking mechanism 122 can be a mechanical means, such as, a ridge rod adapted to engage with the two slide controllers as illustrated in FIG. 1. However, the locking mechanism can also be based on magnets which can be activated, thereby forcing the two sliders to perform corresponding movements. For instance, in one embodiment, the first and second slide controller 120*a*, 120*b* are related to two different light commands which are controlled based on a parametric value, and the position of the slide controllers 120*a*, 120*b* set the parametric value. The parametric value can be set by positioning the slide controllers 120*a*, 120*b* at different positions between the maximum and minimum parametric value. As a consequence, when the first and second slide controllers 120*a*, 120*b* are locked in relation to each other using the locking mechanism 122, the parametric values set by the two slide controllers 120*a*, 120*b* will change simultaneously and with the same change rate. As illustrated, the two slide controllers 120*a*, 120*b* can be locked in a shifted/offset position, where the slide controllers 120*a*, 120*b* are set at different parametric values but where the two parametric values will change at the same rate. It is noticed that it also is possible to lock the first and second slide controllers 120*a*, 120*b* at corresponding parametric values, such that the parametric values will be identical when one of the slide controllers 120*a*, 120*b* are moved.

This set up makes it possible for the person executing the light show using the light controller 101 according to the present invention to execute the light commands related to the first slide controller 120*a* and the second slide controller 120*b* individually when the locking mechanism 122 is not used, and also link the light commands associated with the first and second light controllers 120*a*, 120*b* together using the locking mechanism 122, thereby ensuring that the light commands are changed in a similar manner.

This is, for instance, very useful when video content and light content needs to be faded synchronously as the video content can be associated with the first slide controller 120*a* and the light content can be associated with the second slide controller 120*b*. Further, this is useful when executing different effect functions of a light fixture, where the effect functions are controlled using two different parametric values, as the locked slide controller pair makes it possible to change the parametric values for the effect function simultaneously. Such effect functions can for instance be those described in the patent application PCT/DK2012/050326 titled "METHOD OF PRIORITIZING AND SYNCHRONIZING EFFECT FUNCTIONS IN AN ILLUMINATION DEVICE" as filed on Aug. 31, 2012 which is incorporated herein by reference.

Figure 2:
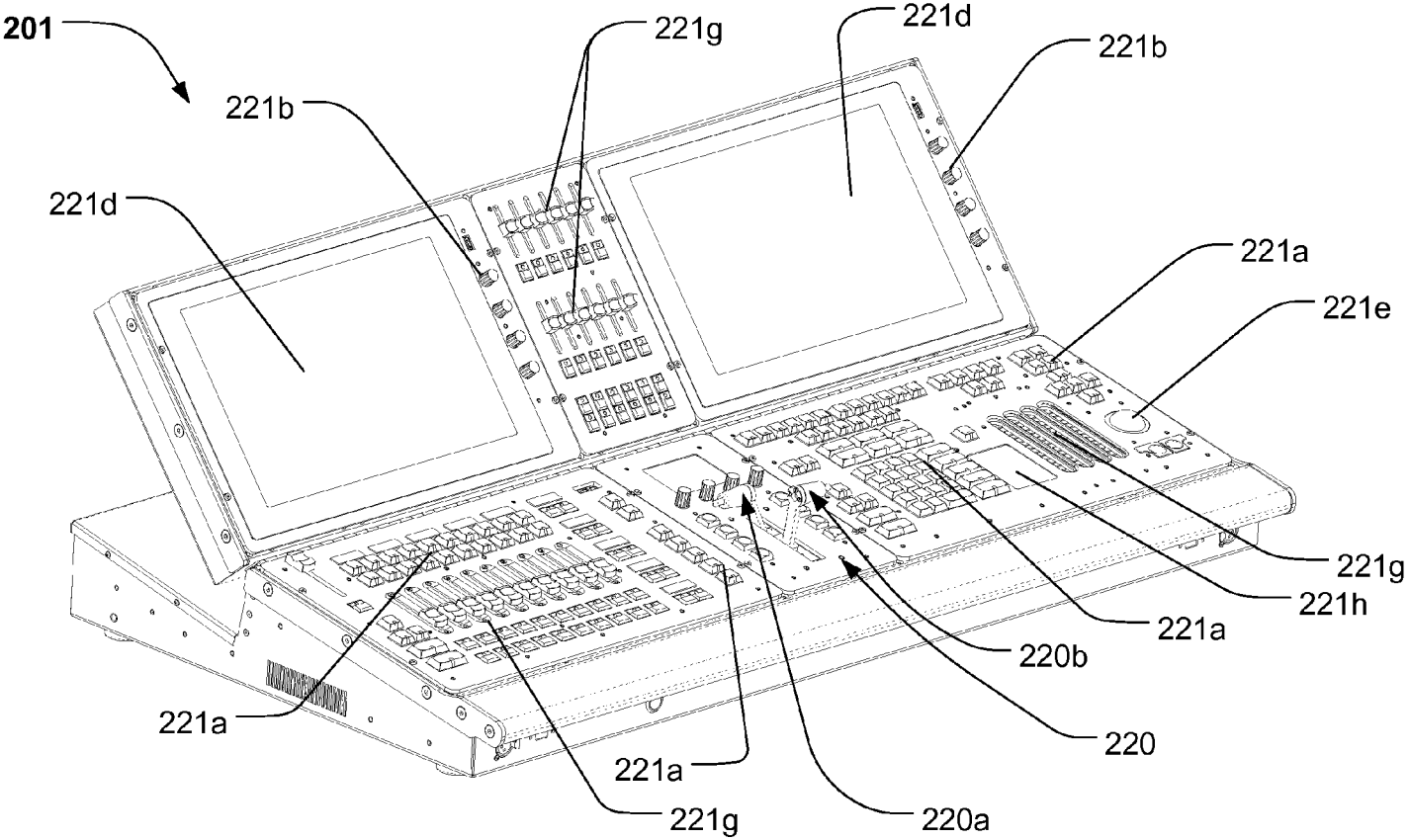
FIG. 2 illustrates a light controller according to the present invention.

FIG. 2 illustrates a light controller 201 according to the present invention. As described above, the light controller 201 can be connected to a number of entertainment devices for instance controllable light fixtures, controllable light emitting visual devices and/or controllable display devices (adapted to emit video). A processor is adapted to send light control commands to the entertainment devices based on a number of control commands stored in a memory and using a communication interface as known in the entertainment lighting industry and as describe above.

The light controller 201 comprises a number of user input interfaces such as, buttons 221*a*, rotary buttons 221*b*, track balls 221*e*, traditional slide controllers 221*g*, a touch pad 221*h*. Further, two touch screens 221*d* are provided and can be used to show information and receive user inputs.

The input interface of the light controller 201 also comprises a lockable slide controller module 220 comprising a first slide controller 220*a* and a second slide controller 220*b* (or lockable slide controller pair). The lockable slide controller pair 220*a*, 220*b* is shown in further detail in FIGS. 3*a* and 3*b*, and the lockable slide controller module 220 is shown in further detail in FIGS. 4*a*-4*b*.

Figure 3B:
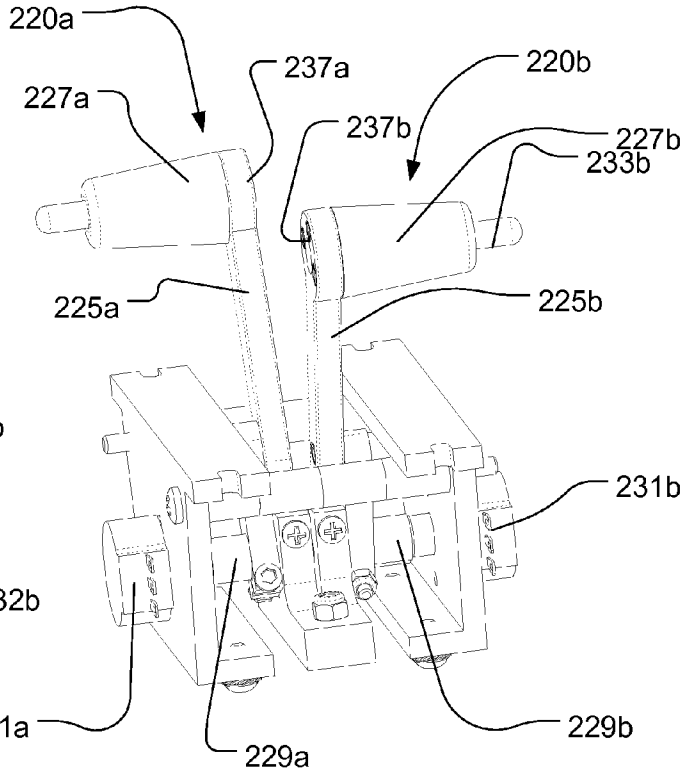
FIGS. 3*a* and 3*b* illustrate a lockable slide controller pair used in a light controller according to the present invention.
Figure 3A:
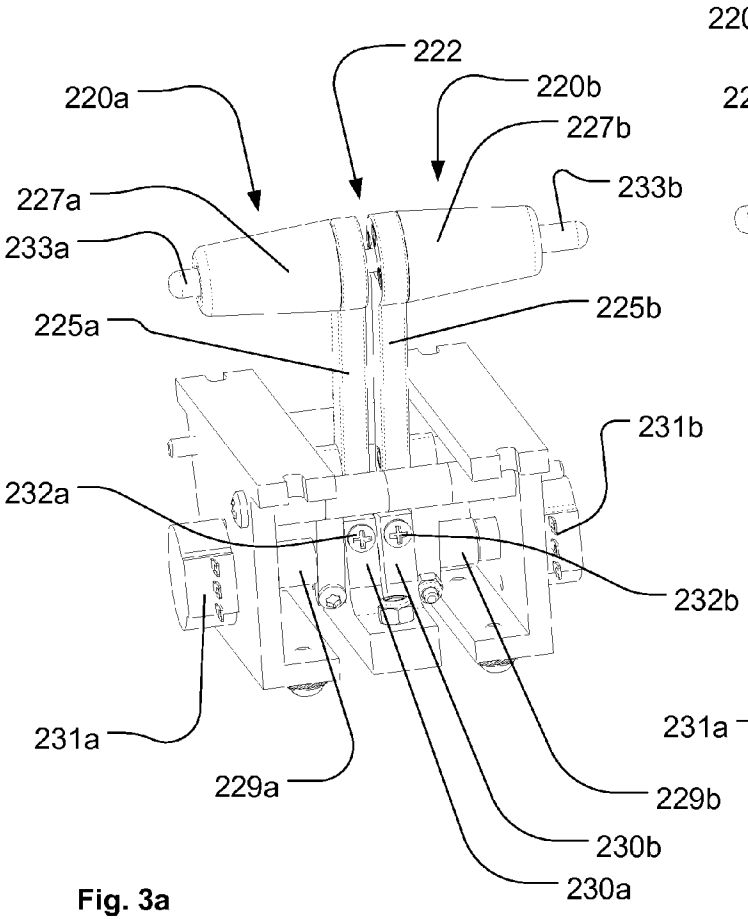

FIGS. 3*a* and 3*b* illustrates the lockable slide controller pair 220*a*, 220*b* used in the light controller 201 according to the present invention. FIG. 3*a* illustrates the lockable slide controller pair 220*a*, 220*b* in a locked position, and FIG. 3*b* illustrates the lockable slide controller pair 220*a*, 220*b* in an unlocked/split arrangement. Each of the slide controllers 220*a*, 220*b* are moveable between a minimum position and a maximum position, and can be positioned at a number of positions between the minimum position and the maximum position. In this embodiment, each slide controller 220*a*, 220*b* is formed as a lever 225*a*, 225*b* having a handle 227*a*, 227*b* at one end, and where the other end is rotatable attached to an axle 229*a*, 229*b*. Each axle 229*a*, 229*b* is at one end supported by an annular support structure 230*a*, 230*b*. Each annular support structure 230*a*, 230*b* is embodied as an open ring wherein the axle is supported and the open ring comprises fastening means 223*a*, 223*b* adapted to adjust the size of open ring, whereby the tension between the annular support structure 230*a*, 230*b* and the axle 229*a*, 229*b* can be adjusted. As a consequence the force needed to move the first and second slide controllers 220*a*, 220*b* can be adjusted.

The rotatable encoders 231*a*, 231*b* are respectively adapted to encode the angular rotation of the axis 229*a*, 229*b* and send (through a communication system as known in the art of electronics) information indicative of the angular rotation to the processor. The rotatable encoders 231*a*, 231*b* can be any encoders capable of detecting the angular position of the axis 229*a*, 229*b* and can, for instance, be magnetic based encoders, optical based encoders, resistance based encoders, etc.

The lockable slide controller pair 220*a*, 220*b* comprises a locking mechanism 222 adapted to fix the first slide controller 220*a* and the second slide controller 220*b* in relation to each other, such that movement the first slide controller 220*a* forces the second slide controller 220*b* to perform a corresponding movement and/or such that movement the second slide controller 220*b* forces the first slide controller 220*a* to perform a corresponding movement.

In the illustrated embodiment, the locking mechanism 222 is embodied as a movable split 233*a* arranged in the handle 227*a* of the first slide controller 220*a*. The movable split 233*a* can be moved inside a hole in the handle 227*a* and be moved between an unlocked position (shown in FIG. 3*b*) and a locked position (shown in FIG. 3*a*). In the locked position, the movable split 233*a* protrudes from the handle 227*a* and towards the handle 227*b* of the second slide controller 220*b* and is adapted engage with a hole 237*b* at the second slide controller 220*b*.

It is noticed that the second slide controller 220*b* also comprises a movable split 233*b*, which can be moved inside the handle 227*b* and between an unlocked position and a locked position. In the locked position, the movable split 233*b* protrudes from the handle 227*b* and towards the handle 227*a* of the first slide controller 220*a* and is adapted to engage with a hole 237*a* at the first slide controller 220*b*. Further, the movable splits 233*a*, 233*b* are arranged with a locale click mechanism which locks the splits in the locked or unlocked position. As a consequence, the lockable slide controller pair 220*a*, 220*b* can be locked by activating either the first movable split 233*a* at the first handle or by activating the second movable split 233*b* at the second handle.

As shown in FIGS. 3*a*-3*b*, the lockable slide controllable pair 220*a*, 220*b* are formed as a T-shaped handle, where the T-shaped handle is divided in a first half forming the first slide controller 220*a* and a second half forming the second slide controller 220*b*. This makes it possible to provide a controllable slide controller pair 220*a*, 220*b* which can be found very fast by the operator as the T-shape is easy to find and locate at the light controller 201. Further, the T-shape handle provides a very ergonomic handle which can be operated in a smooth way.

In another embodiment, the locking mechanism 222 is formed as magnets adapted to lock the first slide controller 220*a* and the second slide controller 220*b* in relation to each other using magnetic force. For instance, the magnetic force can be activated by attaching two permanent magnetics at the first and second slide controllers 220*a*, 220*b* such that the opposite magnetic poles can be brought close to each other in the locking position whereby magnetic force will lock the two slide controllers 220*a*, 220*b* in relation to each other. Further, in one embodiment the magnets can be embodied as electro-magnets, where the magnetic force adapted to lock the slide controllers 220*a*, 220*b* are activated when power is supplied to the electro-magnets.

Figure 4B:
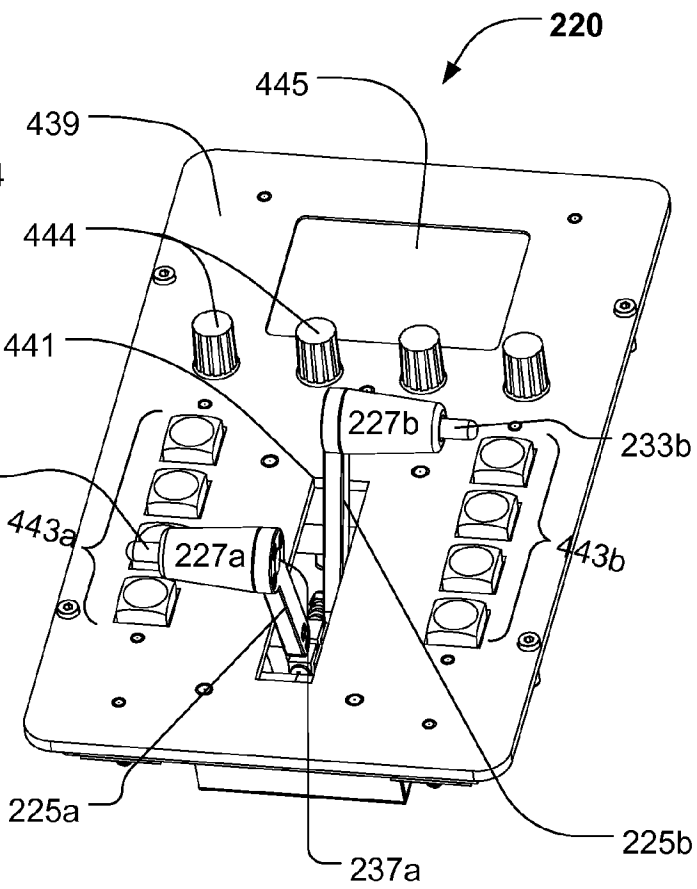
FIGS. 4*a* and 4*b* illustrate a lockable slide controller module used in a light controller according to the present invention.
Figure 4A:
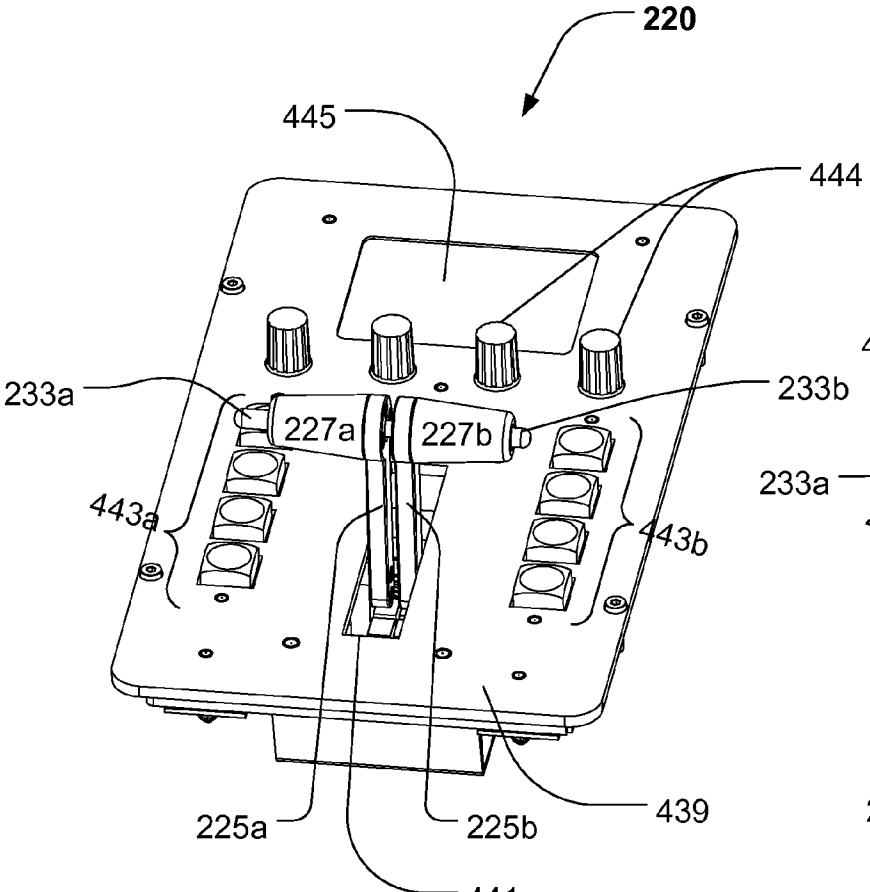

FIGS. 4*a* and 4*b* illustrate the lockable slide controller module 220 used in the light controller 201 according to the present invention. The lockable slide controller module 220 comprises the lockable slide controller pair 220*a*, 220*b* as shown and described in FIGS. 3*a*-3*b*. Similar features are labeled with the same reference numbers as in FIGS. 3*a*-3*b* and will not be described further in connection with FIGS. 4*a*-4*b*. The lockable slide controller module 220 comprises a housing having a top plate and the housing can be arranged and integrated into the light controller 201. It is noticed that the housing can be arranged and integrated into the light controller 201. For instance, fasteners may be used to mechanically fix the slide lockable controller module 220 to the light controller 201. Electric connectors may be used to provide electrical connections to the components of the module 220. The housing comprises a top plate 439 and the levers 225*a*, 225*b* of the lockable side controller pair 220*a*, 220*b* extend through a slit 441 in the top plate 439, whereby the handles of the lockable slide controller can be accessed from above. The remaining components (shown in FIGS. 3*a*-3*b*) are arranged in the housing below the top plate 439. In FIG. 4*a*, it is noticed that it is the movable split 233*b* that performs the locking action.

The lockable slide controller module 220 comprises a first set 443*a* of buttons and a second set 443*b* of buttons. At least one of the buttons of the first set 443*a* of buttons are associated with at least one control command, and when activated, it is adapted to link the at least one control command to the first slide controller 220*a*. Similarly, at least one of the buttons of the second set 443*b* of buttons are associated with at least one control command, and when activated, it is adapted to link the second slide controller 220*b* to the at least one control command.

This makes it possible for the light operator to quickly assign different control commands which can be controlled by the first and second slide controllers 220*a*, 220*b*, as the input from the first and second slide controllers 220*a*, 220*b* can be linked to the control commands associated with the buttons of the first and second set 443*a*, 443*b*. The first set and second set of buttons 443*a*, 443*b* can be implemented as a multi selection set of buttons, where the first and second slide controllers 220*a*, 220*b* are adapted to control all the control commands associated with the activated buttons. For instance, if two buttons are activated, then the slide controllers 220*a*, 220*b* will be adapted to control both control commands simultaneously. Alternatively, the first and second set of buttons 443*a*, 443*b* can be implemented as only one selection set of buttons, where the buttons of each set 443*a*, 443*b* are adapted to deactivate the other buttons of the set when activated. This ensures that only control commands are associated with the slide controllers 220*a*, 220*b*, which can be useful for the light operator in some cases.

The lockable slide controller module 220 also comprises a set of encoders 444 (shown as rotary encoders). At least one of the encoders 444 is associated with the first and second slide controllers 220*a*, 220*b* and parametric values provided by the first and second slide controllers 220*a*, 220*b*. The at least one encoder 444 is adapted to shift the parametric values recorded by the first and second slide controllers 220*a*, 220*b* in relation to each other. This makes it possible to provide an offset of the parametric values provided by the first and second slide controllers 220*a*, 220*b* if they are arranged and locked in the same position. This is useful when the light operator wants to fade two light effects with the same rate, such that the light effects are faced with an offset.

In one embodiment, the encoders 444 are associated with a first one of the first set of buttons 443*a* and a first one of the second set of buttons 443*b*. This makes it possible to provide a shift in the different control commands, which can be selected by the buttons. For instance, the encoder at the outer most left position can be adapted to provide a shift between the control commands associated with the top most button of the first set of buttons 443*a* and the top most button of the second set 443*b*. Similarly, the next encoder can be associated with the buttons at the second position from the top and so on.

The locked slide controller module 220 also comprises a screen adapted to display 445 information related to the first and second slide controller 220*a*, 220*b*. This information can, for instance, show which light effects/control commands are associate with the slide controllers 220*a*, 220*b*, the parametric value provided by the slide controllers 220*a*, 220*b*, and the provided shift/offset between the parametric values. The content of the screen can further be adapted according to which buttons 443*a*, 443*b* have been activated. The screen can also be provided as a touch sensitive screen enabling the user to enter user input related to the locked slide controller pair 220*a*, 220*b* simply by touching the touch sensitive screen.

Figure 5:
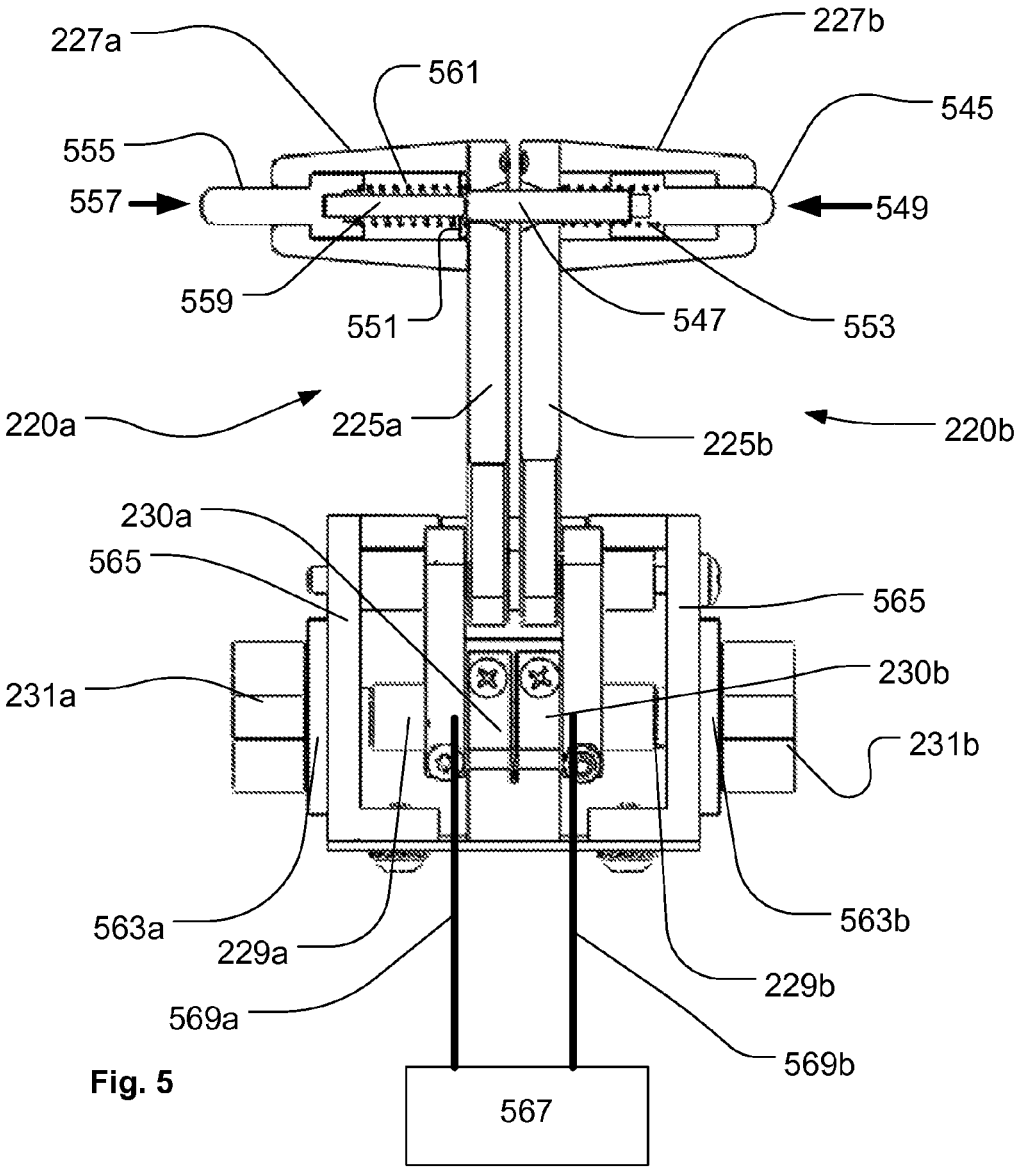
FIG. 5 illustrates a cross sectional view of another embodiment of the lockable slide controller pair used in a light controller according to the present invention.

FIG. 5 illustrates a cross sectional view of another embodiment of the lockable slide controller pair 220*a*, 220*b* used in a light controller according to the present invention. The lockable slide controller pair 220*a*, 220*b* is similar to the lockable slide controller pair 220*a*, 220*b* shown and described in FIGS. 3*a*-3*b*. Similar features are labeled with the same reference numbers as in FIGS. 3*a*-3*b* and will not be described further in connection with FIG. 5.

In this embodiment, the locking mechanism 222 comprises a movable locking split 545 adapted to lock the two slide controllers 220*a*, 220*b* by pushing a locking magnet 547 in the direction as indicated by arrow 549, whereby the locking magnet 547 is positioned between the two slide controllers 220*a*, 220*b* and performs a locking function, as shown in FIG. 5. When the movable locking split 545 is pressed, the locking magnet 547 will be magnetically "glued" to a steel metal ring 551 arranged in slide controller 220*a* and thereby be keep in the locking position. A spring 553 is adapted to pull the movable locking split 545 back to its original position.

The locking mechanism 222 further comprises a movable unlocking split 555 adapted to unlock the first and second slide controllers 220*a*, 220*b* by pushing the locking magnet 547 in the direction indicated by arrow 557. The unlocking split 555 comprises a non-magnetic unlocking pin 559 which pushes the locking magnet out of the handle 227*a*, through the spacing between the two slider controllers further and into to the handle 227*b*. The non-magnetic unlocking pin 539 will not be magnetically "glued" to the metal ring 551 and thus be retracted back to its original position by the spring 561.

Further, in this embodiment, the lockable slide controller pair 220*a*, 220*b* comprises a locking detector adapted to detect whether or not the first slide controller 220*a* and the second slide controller 220*b* are fixed in relation to each other. In other words, the locking detector is adapted to detect whether or not the locking mechanism 222 is activated.

In this embodiment, the locking detector is provided by electrically isolating the first 220*a* and the second slide controllers 220*b* from each other. This is achieved by providing electric isolation pads 563*a*, 563*b* between the support structure 565 and the rotatable encoders 231*a*, 231*b* and also providing the annular support structures 230*a*, 230*b* in an electric isolating material.

The first and second levers 225*a*, 225*b* are made of electric conducting material, for example, aluminum, stainless steel or other kind of metal. The first and second levers 225*a*, 225*b* are electrically connected when the locking magnet 547 is in the locking position. This fact can be used to provide a locking detecting mechanism 567.

In the illustrated embodiment, the locking detection mechanism 567 is embodied as detection circuit (shown as a block for simplicity) which is electrically connected 569*a*, 569*b* to the two levers 225*a*, 225*b*). The detection circuit can determine whether or not the locking mechanism 567 is activated by measuring the impedance provided between the two electrical connections 569*a*, 569*b*, as the impedance will decrease when the locking mechanism 567 is activated/locked. Also, the detection mechanism can provide an electric potential to one to one of the electrical connections 569*a*, 569*b* and measure whether or not current flows between the electrical connections 569*a*, 569*b*. When the locking mechanism 222 is locked, the current will flow through both levers and the locking magnet 547. When the locking mechanism 222 is unlocked, the current is interrupted because the magnet 547 is retrieved.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A light controller for controlling a lighting system, where said lightning system comprises a number of light emitting devices;

said light controller comprises:

a memory adapted to store a number of control commands associated with at least one of said number of light emitting devices;

a communication interface adapted to send said control commands to said number of light emitting devices;

a processor adapted to send said control commands to said number of light emitting devices using said communication interface;

a user input interface adapted to receive a user input from a user;

wherein said input interface comprises:

a first slide controller positionable between a minimum position and a maximum position, said first slide controller can be positioned at positions between said minimum position and said maximum position; and a second slide controller positionable between a minimum position, and a maximum position, said second slide controller can be positioned at positions between said minimum position and said maximum position;

wherein said user input interface further comprises a locking mechanism adapted to fix said first slide controller and said second slide controller in relation to each other, such that movement of at least one of said first slide controller and said second slide controller forces the other slide controller to perform a corresponding movement, and wherein said locking mechanism is formed as movable locking magnet arranged inside a hole of said first slide controller, said movable locking magnet is movable between an unlocked position and a locked position, where in said locked position, said movable locking magnet protrudes from first slide controller and towards said second slide controller and is adapted engage with a hole at said second slide controller and will be magnetically attracted to a metal ring arranged in said hole at said second slide controller.

2. The light controller according to claim 1 wherein said locking mechanism is adapted to fix said first and said second slide controller in relation to each other such that said first and said second slide controller are positioned at substantially the same position between said maximum and said minimum position.

3. The light controller according to claim 1 wherein said first slide controller comprises a movable locking split adapted to push said movable locking magnet inside said hole of said first slide controller from said unlocked position and to said locked position.

4. The light controller according to claim 1 wherein said first slide controller comprises a movable locking split adapted to push said movable locking magnet inside said hole of said first slide controller from said unlocked position and to said locked position.

5. The light controller according to claim 1 wherein said first and said second slide controllers are formed as a T-shaped handle, where said T-shaped handle is divided in a first half forming said first slide controller and a second half forming said second slide controller and wherein said movable locking magnet is arrange inside a hole of said first half of said T-shaped handle, where in said locked position, said movable locking magnet protrudes from first half of said T-shaped handle and towards said second half of said T-shaped handle and is adapted engage with a hole at said second half of said T-shaped handle and where said metal ring is arranged in said hole of said T-shaped handle.

6. The light controller according to claim 5 wherein said first half of said T-shaped handle comprises a movable locking split adapted to push said movable locking magnet inside said hole of said first half of said T-shaped handle from said unlocked position and to said locked position.

7. The light controller according to claim 5 wherein said second half of said T-shaped handle comprises a movable unlocking split adapted to push said movable locking magnet out of said hole of said second half of said T-shaped handle.

8. The light controller according to claim 5 wherein said user input interface comprises:

at least one first button, where said at least one first button when activated is adapted to link said first slide controller with at least one of said control commands; and at least one second button, where said at least one second button, when activated, is adapted to link said second slide controller with at least one of said control commands.

9. The light controller according to claim 5 wherein said user input interface comprises at least one encoder, said at least one encoder being adapted to shift parametric values provided by said first slide controller and said second slide controller in relation to each other.

10. The light controller according to claim 5 wherein said user input interface comprises at least one display, said at least one display being adapted to display information related to said first slide controller and said second slide controller.

11. The light controller according to claim 5 wherein said light controller comprises a locking detector adapted to detect whether or not said first slide controller and said second slide controller are fixed in relation to each other.

12. The light controller according to claim 11 wherein said first slide controller and said second slide controller are electronically isolated from each other and wherein said locking mechanism provides an electrical connection between said first slide controller and said second slide controller when said locking mechanism fixes said first slide controller and said second slide controller in relation to each other and in that said locking detector detects if said electrical connection between said first slide controller and said second slide controller has been established.

13. The light controller according to claim 1 wherein said user input interface comprises:

at least one first button, where said first button when activated, is adapted to link said first slide controller with at least one of said control commands;

at least one second button, where said second button when activated, is adapted to link said second slide controller with at least one of said control commands.

14. The light controller according to claim 1 wherein said user input interface comprises at least one display, said at least one display being adapted to display information related to said first slide controller and said second slide controller.

15. A light controller for controlling a lightning system, where said lightning system comprises a number of light emitting devices;

said light controller comprises:

a memory adapted to store a number of control commands associated with at least one of said light emitting devices;

a communication interface adapted to send said control commands to said light emitting devices;

a processor adapted to send said control commands to said number of light emitting devices using said communication interface;

a user input interface adapted to receive user input from an user;

wherein said input interface comprises:

a first slide controller positionable between a minimum position and a maximum position, said first slide controller can be positioned at positions between said minimum position and said maximum position;

a second slide controller positionable between a minimum position, and a maximum position, said second slide controller can be positioned at positions between said minimum position and said maximum position;

wherein said input interface further comprises a locking mechanism adapted to fix said first slide controller and said second slide controller in relation to each other, such that movement of at least one of said first slide controller or said second slide controller forces the other slide controller to perform a corresponding movement; and wherein said locking mechanism is formed as at least one magnet adapted to lock said first slide controller and said second slide controller in relation to each other using magnetic force.

16. A light controller for controlling a lightning system, where said lightning system comprises a number of light emitting devices;

said light controller comprises:

a memory adapted to store a number of control commands associated with at least one of said light emitting devices;

a communication interface adapted to send said control commands to said light emitting devices;

a processor adapted to send said control commands to said number of light emitting devices using said communication interface;

a user input interface adapted to receive user input from an user;

wherein said input interface comprises:

a first slide controller positionable between a minimum position and a maximum position, said first slide controller can be positioned at positions between said minimum position and said maximum position;

a second slide controller positionable between a minimum position, and a maximum position, said second slide controller can be positioned at positions between said minimum position and said maximum position;

wherein said input interface further comprises a locking mechanism adapted to fix said first slide controller and said second slide controller in relation to each other, such that movement of at least one of said first slide controller or said second slide controller forces the other slide controller to perform a corresponding movement; and wherein said light controller comprises a locking detector adapted to detect whether or not said first slide controller and said second slide controller are fixed in relation to each other.

17. The light controller according to claim 16 wherein said first slide controller and said second slide controller are electronically isolated from each other and wherein said locking mechanism provides an electrical connection between said first slide controller and said second slide controller when said locking mechanism fixes said first slide controller and said second light controller in relation to each other and that said locking detector detects if said electrical connection between said first slide controller and said second slide controller has been established.

18. A light controller for controlling a lightning system, where said lightning system comprises a number of light emitting devices;

said light controller comprises:

a memory adapted to store a number of control commands associated with at least one of said light emitting devices;

a communication interface adapted to send said control commands to said light emitting devices;

a processor adapted to send said control commands to said number of light emitting devices using said communication interface;

a user input interface adapted to receive user input from an user;

wherein said input interface comprises:

a first slide controller positionable between a minimum position and a maximum position, said first slide controller can be positioned at positions between said minimum position and said maximum position;

a second slide controller positionable between a minimum position, and a maximum position, said second slide controller can be positioned at positions between said minimum position and said maximum position;

wherein said input interface further comprises a locking mechanism adapted to fix said first slide controller and said second slide controller in relation to each other, such that movement of at least one of said first slide controller or said second slide controller forces the other slide controller to perform a corresponding movement; and wherein said user input interface comprises at least one encoder, said at least one encoder being adapted to shift parametric values provided by said first slide controller and said second slide controller in relation to each other.

* * * * *